United States Patent [19]

Sohma et al.

[11] Patent Number: 5,038,558

[45] Date of Patent: Aug. 13, 1991

[54] GAS TURBINE COMBUSTOR AND A METHOD OF COMBUSTION THEREBY

[75] Inventors: Kenichi Sohma, Naka; Shigeru Azuhata, Hitachi; Yasuo Iwai, Katsuta; Tooru Inada, Hitachi; Hironobu Kobayashi, Katsuta; Kiyoshi Narato, Juo; Stephen M. Masutani, Katsuta; Tadayoshi Murakami, Hitachi; Norio Arashi, Hitachi; Yoji Ishibashi, Hitachi; Michio Kuroda, Hitachi, all of Japan

[73] Assignee: Hitachi, Ltd., Tokyo, Japan

[21] Appl. No.: 292,345

[22] Filed: Dec. 30, 1988

[30] Foreign Application Priority Data

Jan. 8, 1988 [JP] Japan ..... 63-2189

[51] Int. Cl.[5] ..... F02C 7/26

[52] U.S. Cl. ..... 60/39.06; 60/737

[58] Field of Search ..... 60/39.06, 733, 737, 60/746, 748

[56] References Cited

U.S. PATENT DOCUMENTS 2,999,359 9/1961 Murray .
3,792,581 2/1974 Handa ..... 60/746
4,173,118 11/1979 Kawaguchi .
4,260,637 4/1981 Markowski et al. .
4,265,615 4/1981 Lohmann et al. .
4,389,848 6/1983 Markowski et al. .
4,474,014 10/1984 Markowski ..... 60/748

FOREIGN PATENT DOCUMENTS 150373 9/1982 Japan .
154853 9/1982 Japan .
41810 2/1986 Japan .

*Primary Examiner*—Louis J. Casaregola
*Assistant Examiner*—Timothy S. Thorpe
*Attorney, Agent, or Firm*—Antonelli, Terry, Stout & Kraus

[57] ABSTRACT

A gas turbine combustor comprises a combustion chamber, a premixing chamber in which hydrocarbon fuel and air are premixed, a nozzle with swirler for swirling and injecting the premixed fuel and air into the combustion chamber, to effect premixed combustion, and a fuel nozzle projecting into the combustion chamber and adapted to inject fuel at region wherein the premixed combustion is completed, so as to effect low air-ratio diffusion combustion thereby to produce reducing substance. NOx produced by the premixed combustion is reduced by reducing reaction with the reducing substances, so that the NOx concentration in the combustion gas is reduced. The combustor further includes an after-air ports on a peripheral wall defining the combustion chamber to effect combustion of unburnt substances.

8 Claims, 1 Drawing Sheet

GAS TURBINE COMBUSTOR AND A METHOD OF COMBUSTION THEREBY

BACKGROUND OF THE INVENTION

This invention relates to a gas turbine combustor and combustion method, and, more particularly, to a gas turbine combustor and combustion method wherein reducing substances for NOx are produced through combustion of fuel supplied to the combustor and NOx produced by premixed combustion is reduced with the reducing substances thereby enabling a reduction in NOx emission of the combustor.

Nitrogen oxides (referred to as NOx) produced by combustion in a gas turbine combustor and called thermal NOx is caused by nitrogen in air. A mechanism for producing the thermal NOx is explained by a Zerdovich mechanism. That is, this is caused by the following elementary reaction.

$$N_2+O_2 \rightarrow NO+N \quad (1)$$

$$N+O_2 \rightarrow NO+O \quad (2)$$

$$N+OH \rightarrow NO+H \quad (3)$$

It can be understood from these reactions that generation of nitrogen atoms by a dissociation reaction of nitrogen molecules in the equation (1) is an initiation reaction. More specifically, nitrogen atoms N produced in the equation (1) are oxidized by oxygen molecules and hydroxyl radicals in the equations (2), (3), respectively, to becomes NO. A series of these reactions increase as a flame temperature increases, whereby an amount of thermal NOx produced increases.

Therefore, the flame temperature must not be increased in order to reduce the production of thermal NOx. At present, a lean-combustion system described below is primarily employed as a low NOx combustion system using this principle, although there is available a system for supplying steam or combustion gas into a combustor or the like.

The lean-combustion system cools a flame temperature with a large amount of air to prevent temperature increase. More specifically, a combustor is controlled so as not to have any area wherein the air ratio, that is, the ratio of an amount of really supplied air to an amount of air necessary for perfect combustion of the supplied fuel or, in other words, the ratio of actual air supplied to the theoretical air required for stoichiometric combustion, is near 1.0 thereby effecting combustion with a high air-ratio of about 2.0 in all of the areas.

Japanese Utility Model Laid-Open No. 57-154853 relating to a lean-combustion system discloses a system for effecting lean-combustion as stably as possible by supplying air into a combustor when an air pressure is low by use of a pressure in a gas turbine casing. Japanese Utility Model Laid-Open No. 57-150373 discloses an air introducing device for a combustor of a gas turbine.

The lean-combustion system for preventing an increase in a combustion temperature by supplying a large amount of premixed air and fuel for forming a high air-ratio premixed combustion flame (flame produced when premixed fuel and air are combusted) has a problem of blow-off. This is because a premixed combustion flame is generally most stable when an air ratio is in the vicinity of 1 and blow-off is liable to arise when the air ratio is greater than 1.

Japanese Patent Laid-Open No. 61-41810 discloses a system wherein fuel is separately supplied into two first and second regions in a combustor, with the fuel in the first region being combusted at a high air-ratio of about 1.2 for perfect combustion, and then NOx produced there is reduced by a low air-ratio combustion flame in the second region including a small amount of oxygen and a large amount of reducing combustible gas. The combustible gas remaining in the second region is oxidized and combusted by air from an after-air port in a rear flow for thereby decreasing an amount of NOx.

Japanese Patent Laid-Open No. 61-41810 does not describe whether the flame in the first region is a premixed combustion flame or a diffusion combustion flame and if the flame is the premixed flame, a problem of blow-off arises.

In addition, in the last-mentioned Patent Laid-Open, a flame interference should occur between a high air-ratio combustion flame and low air-ratio combustion flame, judging a relationship between the locations where both flames are formed from an embodiment disclosed in the Patent Laid-Open. More specifically, the positional relationship of the flames is such that excessive oxygen is diffused from the side of the high air-ratio combustion flame to the side of the low air-ratio combustion flame, while fuel is diffused from the side of the low air-ratio flame. Because of the flame interference, NOx produced from the high air-ratio combustion flame is not effectively reduced by the low air-ratio combustion flame. As a result, there is a problem that the respective flames cannot achieve their roles sufficiently.

SUMMARY OF THE INVENTION

An object of the present invention is to provide a gas turbine combustor and a combustion method, wherein fuel is separately supplied into two regions in the combustor to provide a premixed combustion flame and a low air-ratio diffusion combustion flame, whereby a large thermal load is produced by the former flame and NOx produced therefrom is reduced by the latter flame for decreasing an amount of NOx. The premixed combustion flame is prevented from being blown off and a flame interference between both the flames is prevented to thereby sufficiently reduce the amount of NOx.

A gas turbine combustor according to the invention comprises a combustion chamber, a premixture nozzle equipped with a swirler and disposed at an upstream side of the combustion chamber for injecting a premixed fuel and air of a high air-ratio into the combustion chamber and forming a high air-ratio premixed combustion flame. A central nozzle is disposed, in the combustion chamber so that a tip of the central nozzle is positioned around or downstream of a position where the premixed combustion has been terminated for injecting fuel into the combustor to effect low air-ratio diffusion combustion to produce reducing substances, whereby NOx produced by the premixed combustion is reduced by the low air-ratio combustion flame including the reducing substances. An and after-air port for completely combusts the unburnt combustible composition which is produced by the diffusion combustion.

The above construction of the combustor does not cause the premixed combustion flame and the diffusion combustion flame to interfere with each other, so that NOx is reduced by the reducing substances formed by the diffusion combustion. The position where the premixed combustion has been terminated or completed, that is, a position where not fuel is contained in the combustion gas can be detected by, for example, measuring the concentration of unburnt fuel.

DETAILED DESCRIPTION OF THE INVENTION

The gas turbine combustor according to the present invention includes the premixture injection nozzle with a swirler and produces premixed combustion flame through combustion of premixed fuel and air of a high air-ratio.

Although premixed combustion at an air-ratio of about 1 to 1.6 (1 to 1.2 is preferable from a point of view of obtaining a thermal load by the premixed combustion flame) results in a high flame temperature and produces a considerable amount thermal NOx, such air-ratio also produces a large thermal load. Incidentally, a premixed combustion at an air-ratio of about 1 is most stable in general and the flame by the premixed combustion causes blow-off if the air-ratio increases to a value greater than 1. Therefore, to obtain high combustion efficiency, the flame must be protected to be free from blowing off. In the present invention, the swirler is provided on the nozzle for the high air-ratio premixed combustion flame for the purpose. With the arrangement, when a swirl flow is generated in a flame flow, a negative pressure is produced in the swirl to cause the flame flow to be directed to its center so that the flame is more sufficiently held of stabilized. At the same time, a length of the flame is shortened to make the combustor smaller in size.

The gas turbine combustor further includes the central nozzle for forming low air-ratio diffusion combustion flame, with the diffusion flame reducing NOx produced from the high air-ratio premixed combustion flame.

When a so-called flame interference occurs in which a high air-ratio combustion flame is brought into contact with a low air-ratio combustion flame to cause oxygen to diffuse from the side of the high air-ratio combustion flame to the side of the low air-ratio combustion flame and fuel is diffused from the side of the low air-ratio combustion flame, the respective flames cannot sufficiently perform their roles. Therefore, the present invention prevents the flame interference between both flames by disposing the nozzle tip of the central nozzle for forming the low air-ratio diffusion combustion flame for reducing NOx in a region where no fuel remains in the high air-ratio premixed combustion flame and only oxides composed of NOx, oxygen, nitrogen and the like produced by combustion exist, i.e., in the rear flame flow region wherein the combustion process has terminated. With the arrangement, both flames do not cause the flame interference so that the respective flames sufficiently performs their roles such that the high air-ratio premixed combustion flame provides a high thermal load through high combustion efficiency and the low air-ratio diffusion flame reduces NOx.

Figure 1:
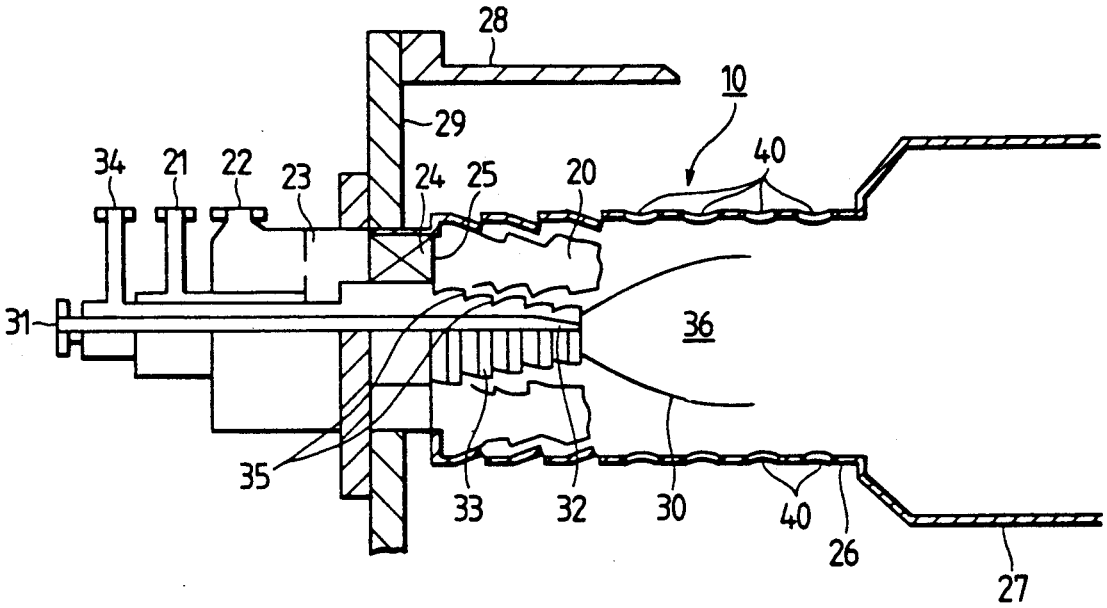
FIG. 1 is a vertical cross sectional view illustrative of an embodiment of a gas turbine combustor according to the present invention.

As shown in FIG 1, a gas turbine combustor generally designated by the reference numeral 10 comprises an inner cylindrical casing 26 axially elongated for defining a combustion chamber 36 therein. The inner casing 26 has a front end mounted on an end plate 29 of an outer casing 28. The outer casing 28 is disposed coaxially with the inner casing 26 with an annular space therebetween. The annular space communicates with a compressor (not shown) and the combustion chamber 36, whereby air is introduced from the compressor into the combustion chamber 36 through the annular space and many air holes made in the side wall of the inner casing 26. The other end of the inner casing 26 is joined to a larger diameter inner casing 27 defining a dilution zone.

The combustor further comprises a premixture injection nozzle 25 and a fuel injection nozzle 32. The premixture injection nozzle 25 is mounted on the front end of the inner casing 26 and is equipped with a swirler 24 annularly formed along the inner periphery of the front end of the inner casing 26, with a central axis of the premixture injection nozzle 25 coninciding with a central axis of the inner casing 26.

A premixture of fuel and air is formed in a premixing chamber 23 disposed out of the combustion chamber 36 and upstream of the premixture injection nozzle 25. The premixing chamber 23 communicates with an air supply port 21 and a fuel supply port 22 to receive air and fuel therefrom. A hollow conically cylindrical air supply nozzle 33, provided with a plurality of series arranged multi-stage air supply ports 35, is mounted at the front end of the inner casing 26 so as to project into the combustion chamber 36 through the premixture injection nozzle 25. The fuel nozzle 32 is disposed in the air supply nozzle 33 so as to be coaxial with the central axis of the premixture injection nozzle 25. The fuel nozzle 32 has one end forming a nozzle tip disposed in the combustion chamber 36 for injecting fuel therein and the other end communicating with a fuel supply port 31. The air supply ports 35 communicates with an air supply port 34 for supplying air thereto.

According to the present invention, fuel (hydrocarbon fuel, e.g., methane in general) is divided into two portions, one portion of which is supplied to form a flame 20 and the other portion of which is supplied to form a diffusion combustion flame 30 at a low air ratio of about 0.8 to decrease an amount of NOx of premixed combustion at a high air-ratio of about 1.2 in the same combustor 10 for obtaining a large thermal load from the flame 20. Further, NOx produced from the premixed combustion flame 20 is reduced by reducing substances such as $NH_3$, HCN, hydrocarbon compounds existing in the diffusion combustion flame 30. As a low air-ratio, it is preferable to be 0.6 to 1.0 for obtaining reducing chemical species such as for example, $NH_3$, .NH, .CH, H.C., .H.C. etc.

The high air-ratio premixed combustion flame 20 is formed when fuel supplied from the fuel supply port 22 and air supplied from the air supply port 21 are mixed into a premixture of gas in the premixing chamber 23 and the premixture is ejected through the premixture injection nozzle 25 for the high air-ratio premixed combustion flame provided with the swirler 24 for swirl flow generation. Since a flow of the flame becomes a swirl flow, a negative pressure region is produced in the vicinity of the center of the swirl flow thereby producing an inwardly reversing so that a length of the flame is shortened to make the combustor 10 smaller in size and a flame stabilizing capability for the high air-ratio combustion flame, which is otherwise liable to be blown off, is improved, whereby blow-off can be prevented.

The low air-ratio diffusion combustion flame 30 is formed by ejecting fuel supplied from the fuel supply port 31 through the fuel nozzle 32 at the center and is used to reduce NOx produced from the high air-ratio combustion flame 20.

Figure 2:
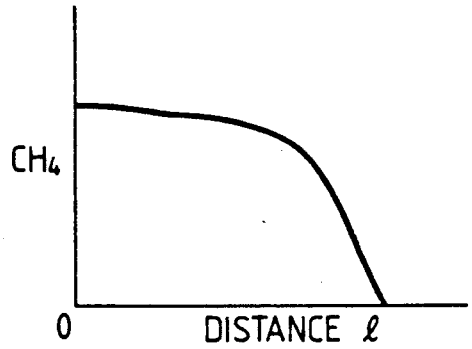
FIG. 2 is a graphical illustration of a result of a gas analysis explanatory of a point where a high air-ratio premixed combustion terminates.

In order to prevent the occurrence of a flame interference between the two flames 20, 30, the nozzle tip of the fuel nozzle 32 is disposed at a rear flow of the high air-ratio premixed combustion flame 20 so that it ejects fuel at a position where a combustion reaction of the flame 20 has terminated. The position where the combustion reaction terminates is determined based on a result of a gas analysis shown below. That is, a gas in the high air-ratio premixed combustion flame 20 is sequentially sampled at respective distances l (FIG. 2) in the direction of the flame flow to analyze concentration of methane in the gas and a position where the concentration of the methane is 0% is determined to be the position where the combustion reaction terminates, i.e., a flame end. The distances l showing that the methane concentrations are greater than 0% represent a flame where combustion reaction goes on. Accordingly, the gas at distances l beyond the aforesaid distances contains no methane fuel methane and then a flame is no longer formed and no combustion reaction occurs, that is, it is only a high temperature exhaust gas and no flame.

The fuel nozzle 32 for forming the low air-ratio diffusion flame 30 has the nozzle tip just disposed at the position where the combustion reaction of the high air-ratio premixed combustion flame 20 terminates.

Although a value of the distance l where the methane concentration becomes 0% slightly changes depending on a condition of combustion or the like, the methane concentration becomes 0% at the point where the combustion terminates, which determines a positional relationship between the premixture injection nozzle 25 for the high air-ratio premixed combustion flame and the fuel nozzle 32 for the low air-ratio diffusion combustion flame.

With the above disposition, the two combustion flames 20, 30 can sufficiently perform their roles, that is, the flame 20 is combusted efficiently to provide a high thermal load and the flame 30 reduces NOx.

The fuel nozzle 32 disposed at the center of the combustor 10 is cooled because it may be damaged by the high-temperature premixed combustion flame 20 with the high air-ratio and combustion air is supplied to the low air-ratio diffusion combustion- flame 30 so that the air supply nozzle 33 has multi-stage air ejecting ports 35 in series and is concentrically disposed around the outer circumference of the nozzle 32, with air being supplied to the air supply nozzle 33 from the air supply port 34.

The low air-ratio diffusion combustion flame 30 produces carbon monoxide and excessive hydrocarbon compounds as well as NOx reducing compounds ($NH_3$, HCN, hydrocarbon compounds and the like). The discharge of carbon monoxide, excessive hydrocarbon compounds and NOx reducing compounds from an outlet of the combustor 10 is not only harmful but also disadvantageous from a view point of energy saving. In the present invention, after-air ports 40 are disposed to solve these problems. The carbon monoxide and the hydrocarbon compounds are combusted by air entering into the combustor 10 from the after-air ports 40 to render the compounds harmless and to produce combustion heat.

Some of the after-air ports 40 are, for example, disposed around a position where diffusion combustion flame is terminated and the others are disposed downstream of the former after-air ports 40.

Figure 3:
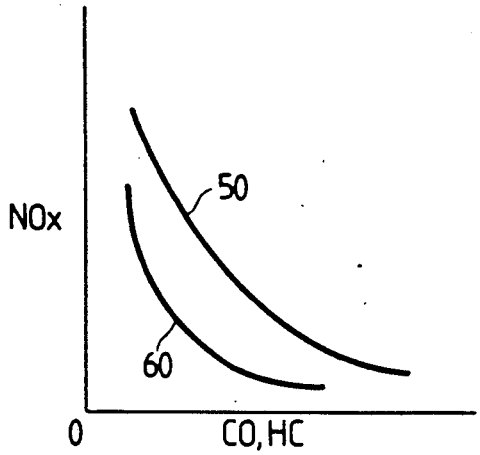
FIG. 3 is a graphical illustration comparing the result of a combustion test of a combustor of the present invention with that of a combustor shown in FIG. 1 of Japanese Patent Laid-Open No. 61-41810.

FIG. 3 shows a result of a combustion test effected using the combustor of the present invention in comparison with a result of a combustion test effected using a conventional combustor, i.e., a combustor wherein a high air-ratio premixed combustion flame and a low air-ratio diffusion combustion flame are positioned at the same position and a flame interference arises between both flames. A horizontal axis represents a concentration of an unburnt combustible composition (CO and hydrocarbon compounds) in an exhaust gas from the combustor as one of indexes showing inferior combustibility and a vertical axis represents a concentration of NOx in the exhaust gas from the combustor. Values on the horizontal axis and the vertical axis mean that combustion is effected more efficiently with a less amount of NOx as they are nearer to the origin. A curve 60 shows a better result of an efficient combustion with a less amount of NOx obtained by the present invention as compared with a curve 50 showing a result of a conventional type combustor.

According to the present invention, the nozzle for forming a high air-ratio premixed combustion flame 20 is provided with the swirler 24. As a result, no blow-off is caused, even if the premixed combustion flame 20 is produced at the high air-ratio combustion because a flame stabilizing capability is improved. Further, a flame length is shortened to make the combustor smaller in size.

When NOx produced from the high air-ratio premixed combustion flame 20 is reduced by the low air-ratio diffusion flame 30 or products therefrom, no flame interference occurs between both the combustion flames 20, 30 because the nozzle tip of the nozzle for the air-ratio diffusion is disposed at the rear flame flow position where the combustion process of the high air ratio premixed combustion flame 20 has terminated and no fuel is contained in its combustion exhaust gas. Therefore, the high air-ratio premixed combustion flame 20 provides a large thermal load at a high combustion efficiency and the low air-ratio diffusion flame 30 reduces NOx for decreasing an amount of NOx, whereby the respective combustion flames 20, 30 can sufficiently perform their roles.

We claim:

1. A method of combustion comprising the steps of:

premixing fuel and air in a premixing chamber to provide premixed fuel and air at a ratio of actual air supplied to the theoretical air required for stoichiometric combustion greater than 1;

injecting the premixed fuel and air mixture into the combustion chamber while causing the premixed fuel and air to swirl and igniting it to effect premixed combustion during operation of the combustor to thereby produce combustion gas including NOx;

injecting fuel into said combustion chamber at a downstream side of a region wherein the premixed combustion is completed, to effect diffusion combustion so as to produce reducing substances;

reacting NOx contained in the combustion gas with the reducing substances to lower the concentration of NOx in the combustion gas; and introducing combustion air into said combustion chamber at a downstream side of a region wherein the diffusion combustion is effected to thereby effect combustion of unburnt combustible substances, and wherein said region wherein the premixed combustion gas is completed is detected by measuring fuel concentration in a combustion flame, said region being a region where the measured fuel concentration is zero.

2. A method of combustion according to claim 1, wherein the fuel comprises methane and said region wherein the premixed combustion is completed is one wherein the concentration of methane is zero.

3. A method of combustion according to claim 2, wherein fuel is injected into said combustion chamber at downstream side of said region so that said ratio is 1 to 1.6.

4. A method of combustion by a gas turbine combustor, the methane comprising the steps of:

premixing gaseous fuel and air in a premixing chamber outside of a combustion chamber to provide a sufficiently premixed fuel and air mixture;

injecting the premixed fuel and air mixture into the combustion chamber through a swirler to swirl and effect premixed combustion at a ratio of actual air supplied to theoretical air required for stoichiometric combustion in a range of 1 to 1.6 during operation of the combustor to thereby produce a short combustion flame and combustion gases including NOx;

injecting gaseous fuel in said combustion chamber at a downstream side of the short combustion flame so as not to mix with the short combustion flame and effecting an incomplete diffusion combustion so as to produce reducing substances;

reacting NOx contained in the combustion gas with the reducing substances to lower a concentration of NOx in the combustion gas;

introducing combustion air into said combustion chamber at a downstream side of a region wherein the diffusion combustion is effected to thereby effect combustion of unburnt combustible substances; and wherein the gaseous fuel is injected into the combustion chamber at a downstream side of a region wherein the premixed combustion is completed, said region being a region where a fuel concentration is zero.

5. A method of combustion according to claim 4, wherein the gaseous fuel comprises methane and said region wherein the premixed combustion is completed is a region wherein the concentration of methane is zero.

6. A method of combustion according to claim 5, wherein fuel is injected into said combustion chamber at a downstream side of said region and burned at an air ratio of not more than 1.

7. A method of combustion of a gas turbine combustion, the method comprising the steps of:

premixing gaseous fuel and air in a premixing chamber to provide a mixture;

injecting the premixture into the combustion chamber at an upstream side of the combustion chamber and effecting premixed combustion at a ratio of actual air supplied to theoretical air required for stoichiometric combustion in a range of 1 to 1.6 to produce a short flame of complete combustion;

producing reducing substances at a downstream side of said short flame of complete combustion by effecting, incomplete diffusion combustion of gaseous fuel injected into the combustion chamber at a position downstream of said short flame of complete combustion at a position wherein the concentration of gaseous fuel is zero;

reacting NOx contained in the combustion gas resulting from the combustion of the premixture with reducing substances produced by the diffusion combustion to lower the concentration of NOx in the combustion gas; and introducing combustion air into said combustion chamber at a downstream side of a region wherein the diffusion combustion is effected to thereby effect complete combustion of unburnt combustible substances.

8. A method of combustion according to claim 7, wherein the gaseous fuel and air is premixed at a ratio of actual air supplied to the theoretical air required for stoichiometric combustion of not more than 1.

* * * * *